US006793561B2

(12) United States Patent
Bachand et al.

(10) Patent No.: US 6,793,561 B2
(45) Date of Patent: Sep. 21, 2004

(54) REMOVABLE/DISPOSABLE PLATEN TOP

(75) Inventors: David P. Bachand, St. Albans, VT (US); Stuart D. Cheney, Essex Junction, VT (US); Harman S. Garvatt, Winooski, VT (US); Charles A. McKinney, Chazy, NY (US)

(73) Assignee: International Business Machines Corporation, Armonk, NY (US)

( * ) Notice: Subject to any disclaimer, the term of this patent is extended or adjusted under 35 U.S.C. 154(b) by 350 days.

(21) Appl. No.: 09/948,165

(22) Filed: Sep. 6, 2001

(65) Prior Publication Data

US 2002/0006770 A1 Jan. 17, 2002

Related U.S. Application Data

(62) Division of application No. 09/418,275, filed on Oct. 14, 1999, now abandoned.

(51) Int. Cl.[7] ..... B24B 53/00

(52) U.S. Cl. ..... 451/56; 451/443; 451/444; 451/28

(58) Field of Search ..... 451/56, 443, 444, 451/5

(56) References Cited

U.S. PATENT DOCUMENTS

| | | | |
|---|---|---|---|
| 5,658,185 | A | 8/1997 | Morgan, III et al. |
| 5,702,292 | A | 12/1997 | Brunelli et al. |
| 5,743,788 | A | 4/1998 | Vanell |
| 5,800,248 | A | 9/1998 | Pant et al. |
| 5,807,165 | A | 9/1998 | Uzoh et al. |
| 5,865,665 | A | 2/1999 | Yueh |
| 5,868,896 | A | 2/1999 | Robinson et al. |
| 6,083,083 | A | 7/2000 | Nishimura |

*Primary Examiner*—George Nguyen
(74) *Attorney, Agent, or Firm*—DeLio & Peterson, LLC; Kelly M. Reynolds; Anthony Canale

(57) ABSTRACT

The present invention comprises a chemical mechanical polishing tool comprising a polishing platen and a removable, replaceable platen top mounted on a top surface of the platen. Preferably, the platen top comprises a material substantially impervious to the slurries used when planarizing an object. Most preferably, the platen top comprises aluminum alloy or glass. The platen top may be tailored to provide enhanced polishing conditions by acting as an insulator, a conductor or machined to be concave or convex. The invention may further include endpoint sensors attached to the platen top.

17 Claims, 2 Drawing Sheets

REMOVABLE/DISPOSABLE PLATEN TOP

This application is a Divisional of Ser. No. 09/418,275 filed on Oct. 14, 1999 now abandoned.

BACKGROUND OF THE INVENTION

1. Field of the Invention

This invention relates, in general, to the field of semiconductor manufacture. In particular, it relates to a method and apparatus for polishing semiconductor wafers wherein the useful life of the chemical mechanical polishing tool is prolonged.

2. Description of Related Art

Fabrication of semiconductor integrated circuits (IC) is a complicated multi-step process creating microscopic structures with various electrical properties to form a connected set of devices. As the level of integration of IC's increases, the devices become smaller and more densely packed, requiring more levels of photolithography and more processing steps. As more layers are built up on the silicon wafer, problems caused by surface non-planarity become increasingly severe and can impact yield and chip performance. During the fabrication process, it may become necessary to remove excess material in a process referred to as planarization.

A common technique used to planarize the surface of a silicon wafer is chemical mechanical polishing (CMP). CMP involves the use of a polishing pad affixed to a circular polishing platen and a holder to hold the wafer face down against the rotating pad. A slurry containing abrasive and chemical additives are dispensed onto the polishing pad. The wafer and the polishing pad rotate relative to each other. The rotating action along with the abrasive and chemical additives of the slurry results in a polishing action that removes material from the surface of the wafer. Protrusions on the surface erode more efficiently than recessed areas leading to a flattening or planarization of the wafer surface.

As the layers to be removed on the wafer include different types of metal alloys, new chemical slurries must be used which are increasingly corrosive. Typically, the polishing pad sits directly over the rotating polishing platen. The pad itself is chosen for its ability to act as a carrier of the slurry and to wipe away the grit and debris resulting from the polishing action. Thus, the polishing platen is continually exposed to the slurry which leads to eventual corrosion of the platen itself diminishing its useful life. Replacement of the platen is expensive and time consuming thereby increasing manufacturing costs.

Bearing in mind the problems and deficiencies of the prior art, it is therefore an object of the present invention to provide a method and apparatus for decreasing the frequency of platen replacement.

It is another object of the present invention to provide a method and apparatus for prolonging the useful service life of the platen.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a chemical mechanical planarization tool comprising a polishing platen; and a disk-like platen top removably mounted on a top surface of the platen. Preferably, the platen top may comprise a material substantially impervious to a slurry used when planarizing an object, an insulative material, and/or a conductive material. Most preferably, the platen top comprises aluminum alloy or glass. The planarization tool may further include endpoint sensors attached to the platen top.

In another aspect, the present invention is directed to a chemical mechanical polishing tool comprising a polishing table; and a replaceable top removably mounted over the polishing table comprising a material substantially impervious to polishing slurries.

In yet another aspect, the present invention is directed to a chemical mechanical polishing tool comprising a polishing table; and a replaceable top removably mounted over the polishing table comprising borosilicate glass.

In still yet another aspect, the present invention is directed to a chemical mechanical polishing tool comprising a polishing table; and a replaceable top removably mounted over the polishing table comprising aluminum alloy.

In a further aspect, the present invention is directed to a method of prolonging the service life of a chemical mechanical planarization tool comprising the steps of: (a) providing a chemical mechanical planarization tool having a rotatable polishing platen; (b) removing a portion of a top surface of the platen; (c) providing a removable platen top having a substantially similar size and shape of the platen, the platen top comprising a material adapted to withstand a slurry used during activation of the planarization tool; and (d) attaching the platen top to the platen to substantially protect the platen from erosion caused by the slurry.

In a final aspect, the present invention is directed to a method of polishing semiconductor wafers comprising the steps of providing a chemical mechanical polishing tool comprising a rotatable platen; a replaceable platen top disposed over the platen; and a polishing pad disposed over the platen, wherein the platen top substantially protects the platen from erosion; providing at least one semiconductor wafer in need of polishing; and chemical mechanical polishing the wafer with a slurry provided to the polishing pad, the slurry capable of eroding the tool over time.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

Figure 2:
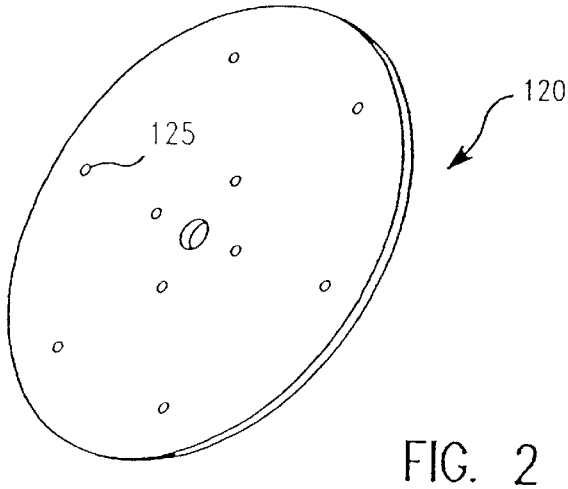
FIG. 2 is a perspective view of a preferred embodiment of the platen top of the present invention.
Figure 3:
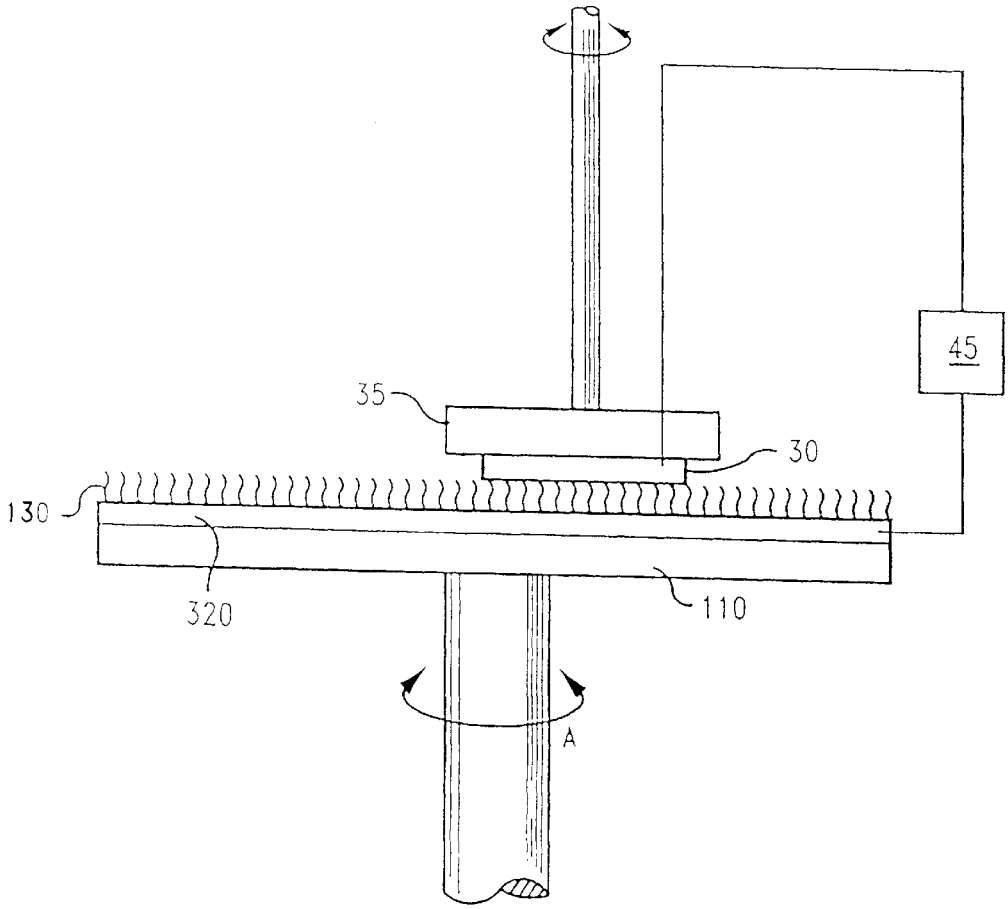
FIG. 3 is a side plan view of a chemical mechanical polishing tool of the present invention employing an endpoint detection system.

In describing the preferred embodiment of the present invention, reference will be made herein to FIGS. 1–3 of the drawings in which like numerals refer to like features of the invention. Features of the invention are not necessarily shown to scale in the drawings.

The present invention teaches a method and apparatus for prolonging the useful life of a chemical mechanical polishing tool. By placing a removable and replaceable platen top on the polishing platen, the useful life of the polishing platen is extended since the platen top serves as a barrier to the harsh slurry chemicals used during CMP.

Figure 1A:
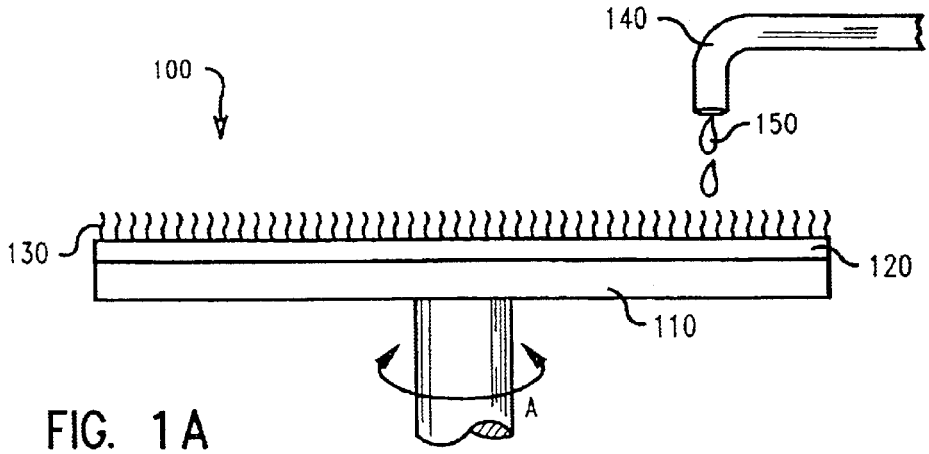
FIG. 1A is a side plane view of a chemical mechanical polishing tool of the present invention having a platen top with a substantially level top surface.
Figure 1B:
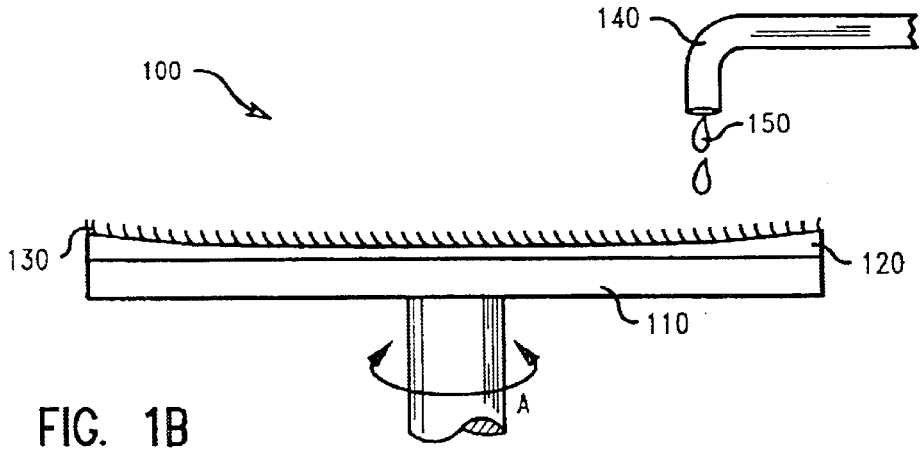
FIG. 1B is a side plane view of a chemical mechanical polishing tool of the present invention having a platen top having a concave surface.
Figure 1C:
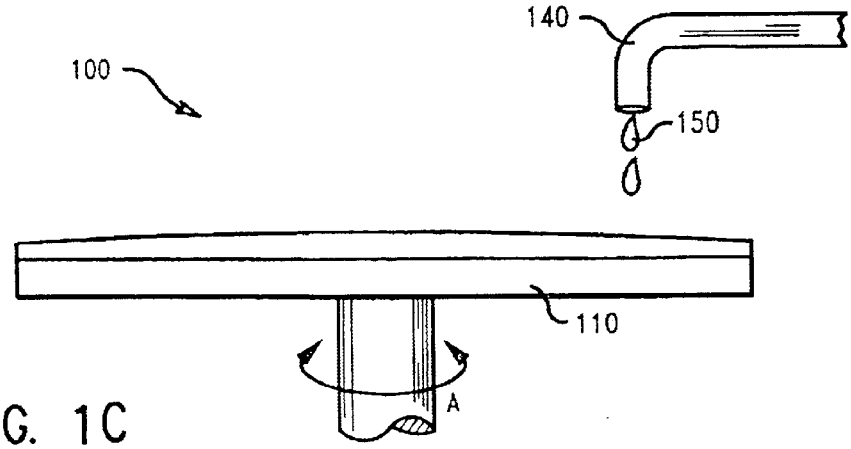
FIG. 1C is a side plane view of a chemical mechanical polishing tool of the present invention having a platen top having a convex surface.

FIG. 1 illustrates a chemical mechanical polishing tool 100 of the present invention comprising a rotatable platen 110 which is rotatable in the direction of arrow A during polishing of an object such as a semiconductor wafer. Platen top 120 is disposed over platen 110 and is preferably fixedly attached to platen 110 by suitable attachment means which would provide a substantially level top surface of platen top 120. For example, counter sink screws may be used in attaching the platen top to the rotatable platen by inserting the screws through apertures 125 (as shown in FIG. 2). Polishing pad 130 is placed over the top surface of platen top 120 as a vehicle for the slurry used to polish the semiconductor wafer surface. A slurry distribution system 140 provides the slurry 150 directly onto the surface of polishing pad 130.

During planarization of a semiconductor wafer, slurry 150 is applied directly onto polishing pad 130 such that the micro-fibers of polishing pad 130 which create microscopic crevices are filled with slurry 150. Slurry 150, depending on the layer of material on the wafer to be removed, typically comprises a suspension of an abrasive, e.g. fumed silica, in a corrosive liquid chemical, e.g. a strong acid or base. A semiconductor wafer in need of polishing would be placed in a wafer carrier with the surface to be polished facing and contacting polishing pad 130. As the use of thin metal alloys on the wafer surface are used in microelectronics manufacture, increasingly corrosive slurries must be used to planarize the wafer surface. The strong acids and bases used continually attack the platen which is typically made of aluminum.

Unexpectedly, the use of a removable platen top extends the service life of the platen. As the CMP tool is used on a continuous basis, the platen underneath is protected by the platen top limiting the exposure of the platen to the corrosive slurries used during planarization. Platen top 120 is more fully illustrated in FIG. 2 as a disk having substantially the same diameter and configuration as platen 110 having a thickness wherein the total thickness of the both the platen top and the platen does not substantially exceed the thickness of the original platen. Preferably, the thickness of the platen top is preferably about 0.9 to about 1.30 cm, and most preferably about 0.95 cm. Preferably, the platen top comprises a material which is chemically inert and substantially impervious to the slurry used during polishing although other materials may be used which provide a benefit to the planarization process as will be discussed below.

The platen top of the present invention also improves planarization when using a slurry which requires a preferred temperature for enhanced performance. By electrically heating the platen top to maintain the slurry at a specific temperature, the rate of planarization may be enhanced. The platen top may comprise a metal or a metal alloy, e.g. an aluminum alloy, which while withstanding the corrosiveness of the slurry may also act as a thermal conductor or insulator to maintain a desired temperature of the slurry for enhanced planarization. The platen top may comprise an insulator material such as glass, e.g. borosilicate glass, which is also substantially impervious to the slurry. The platen top could electrically enhance the insulation of the platen top from the rest of the platen depending on the material chosen for the top. A conductive top could also be used to reduce electrostatic discharge (ESD) build-up and protect the wafer being polished from ESD damage.

Employing the platen top allows a measure of versatility in the manufacturing process of semiconductor wafers. The platen top may be machined to a concave or convex surface such that during polishing, different polishing effects may be effectuated without the need for multiple polishing tools. A concave or convex platen top employed during planarization allows fine tuning of the polishing parameters as they relate to radial regions on the wafer surface which ultimately affects the yield.

Furthermore, the platen top of the present invention allows for improved endpoint detection for measuring or detecting a desired polishing endpoint. An endpoint detection system employing electrical signals would be enhanced with an insulated or conductive platen top depending on the system requirements. As shown in FIG. 3, an endpoint detection system 45 can be implemented using a conductive platen top 320 which, during polishing, provides a conductive pathway to the wafer 30 being polished. Wafer 30 is held against the polishing pad by wafer carrier 35. The electrical signal would traverse through platen top 320 to wafer 30 having conductive polishing stops embedded therein. The conductive stops when exposed, provide for the completion of the sensing network and indicates to the operator or automated polishing tool that an endpoint has been reached. Preferably, the sensing network detects a change in the resistivity as a means for ascertaining an endpoint in the polishing process. However, other electrical parameters such as capacitance, current flow changes or potential differences and the like, may be utilized for the endpoint detection system. Importantly, the insulating or conductive properties of the platen top are instrumental in electrically sensing an endpoint during polishing.

The present invention achieves the objects recited above. In accordance with the present invention, the removable, replaceable platen top provides a means for prolonging the useful service life of a CMP tool by protecting the platen from the corrosive effects of the slurries used during polishing. Once the platen top has worn away, it is far simpler and more economical to replace the platen top rather than the entire platen.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of prolonging the service life of a chemical mechanical planarization tool comprising the steps of:

(a) providing a chemical mechanical planarization tool having a rotatable polishing platen;

(b) removing a portion of a top surface of the platen;

(c) providing a removable platen top having a substantially similar size and shape of the removed portion of the top surface of the platen, said platen top comprising a material adapted to withstand a slurry used during activation of said planarization tool; and (d) attaching said removable platen top to the platen to substantially protect the platen from erosion caused by the slurry wherein said platen and said removable platen top have a combined thickness not exceeding an original thickness of said polishing platen.

2. The method of claim 1, further including the step of providing a second removable platen top to replace said removable platen top upon erosion of said removable platen top by the slurry.

3. The method of claim 1 wherein step (b) comprises removing a sufficient amount of the top surface of the platen such that a combined thickness of the platen subsequent to step (b) and said removable platen top is substantially equal to a thickness of the platen prior to step (b).

4. The method of claim 1 wherein step (b) comprises removing about 0.95 to about 1.30 cm of a top surface of the platen.

5. The method of claim 1 wherein step (c) comprises providing a removable platen top comprising aluminum alloy.

6. The method of claim 1 wherein step (c) comprises providing a removable platen top comprising borosilicate glass.

7. The method of claim 4 wherein step (b) comprises removing about 0.95 to about 1.30 cm of the top surface of the platen, step (c) comprises providing a removable platen top having a thickness of about 0.95 to about 1.30 cm.

8. The method of claim 1 wherein step (c) comprises providing a removable platen top comprising a material substantially impervious to said slurry used when planarizing an object.

9. The method of claim 1 wherein step (c) comprises providing a removable platen top comprising an insulative material.

10. The method of claim 1 wherein step (c) comprises providing a removable platen top comprising a conductive material.

11. The method of claim 1 further including the step of attaching endpoint sensors to said removable platen top adapted to detecting a thickness of an object being polished.

12. The method of claim 1 further including the steps of providing at least one semiconductor wafer in need of polishing over the removable platen top of the rotatable polishing platen, and polishing said at least one semiconductor wafer with said slurry, the slurry capable of eroding said tool over time, wherein said removable platen top protects said rotatable polishing platen from said slurry to extend the useful life of said rotatable polishing platen.

13. A method of prolonging the service life of a chemical mechanical planarization tool comprising the steps of:

providing a rotatable platen having an original thickness;

removing a portion of the rotatable platen;

providing a removable platen top having a substantially similar size and shape of the removed portion of the rotatable platen, said removable platen top is impervious to polishing slurries disposed over said rotatable platen; and attaching said removable platen top to said rotatable platen to substantially protect the rotatable platen from erosion caused by the slurry by attaching the removable platen to the portion of the removed rotatable platen to form a two-part rotatable platen, the two-part rotatable platen having a combined thickness not exceeding an original thickness of said polishing platen.

14. The method of claim 13 wherein the step of removing a portion of the rotatable platen comprises removing about 0.9 cm to about 1.30 cm of a top surface of the rotatable platen.

15. The method of claim 13 further including attaching a polishing pad directly to said removable platen top.

16. The method of claim 13 further including attaching endpoint sensors to said second rotatable platen adapted to detecting a thickness of an object being polished.

17. A method of prolonging the service life of a chemical mechanical planarization tool comprising the steps of:

providing a rotatable platen having an original thickness;

removing about 0.9 cm to about 1.30 cm of a top surface of the rotatable platen;

providing a removable platen top having a substantially similar size and shape of the removed portion of the rotatable platen, the size and shape of the removable platen top ranging from about 0.9 cm to about 1.30 cm depending on the size and shape of the removed portion of the rotatable platen, said removable platen top is impervious to polishing slurries disposed over said rotatable platen; and attaching said removable platen top to said rotatable platen to substantially protect the rotatable platen from erosion caused by the slurry by connecting the removable platen to the portion of the removed rotatable platen to form a two-part rotatable platen, the two-part rotatable platen having a combined thickness not exceeding an original thickness of said polishing platen.

* * * * *